US007506704B2

(12) United States Patent
McGarian et al.

(10) Patent No.: US 7,506,704 B2
(45) Date of Patent: Mar. 24, 2009

(54) DOWNHOLE SWIVEL JOINT

(75) Inventors: Bruce McGarian, Aberdeen (GB); Rory McCrae Tulloch, Aberdeen (GB)

(73) Assignee: Smith International, Inc., Houston, TX (US)

( * ) Notice: Subject to any disclaimer, the term of this patent is extended or adjusted under 35 U.S.C. 154(b) by 178 days.

(21) Appl. No.: 11/344,530

(22) Filed: Feb. 1, 2006

(65) Prior Publication Data

US 2008/0000696 A1 Jan. 3, 2008

(30) Foreign Application Priority Data

Feb. 4, 2005 (GB) ..... 0502349.4

(51) Int. Cl.
*E21B 7/08* (2006.01)
*E21B 17/05* (2006.01)

(52) U.S. Cl. ..... 175/321; 175/320; 166/242.7; 166/334.4

(58) Field of Classification Search ..... 175/320, 175/321; 166/242.7, 334.4
See application file for complete search history.

(56) References Cited

U.S. PATENT DOCUMENTS 4,240,674 A * 12/1980 Evans ..... 384/93
4,793,417 A * 12/1988 Rumbaugh ..... 166/312
6,772,835 B2 * 8/2004 Rogers et al. ..... 166/177.4
7,152,674 B2 * 12/2006 Bowles ..... 166/242.6
7,281,584 B2 * 10/2007 McGarian et al. ..... 166/323
2004/0168832 A1 * 9/2004 Russell et al. ..... 175/321
2005/0230119 A1 * 10/2005 McGarian et al. ..... 166/334.4
2006/0118298 A1 * 6/2006 Millar et al. ..... 166/242.7
2007/0246217 A1 * 10/2007 Tulloch et al. ..... 166/311

* cited by examiner

*Primary Examiner*—Shane Bomar
(74) *Attorney, Agent, or Firm*—Dykema Gossett PLLC

(57) ABSTRACT

A downhole releasable swivel joint comprises a mandrel and a housing. A resilently deformable retaining device maintains the components in the illustrated first relative axial position until downward movement of the housing is stopped and a sufficient load is applied to the mandrel to overcome the retaining force of the retaining device whereupon the mandrel is able to move downwardly relative to the housing to adopt a second relative axial position. Apertures are provided in the wall of the mandrel and apertures are provided in the wall of the housing. When the mandrel is in the illustrated first relative axial position the apertures and are isolated from each other by a seal. When the mandrel is in the second relative axial position the apertures communicate with each other to permit flow from the interior of the mandrel to the exterior of the housing.

11 Claims, 5 Drawing Sheets

DOWNHOLE SWIVEL JOINT

This invention relates to a downhole swivel joint and, more particularly, to a modification and improvement to the downhole swivel joint disclosed in our International patent application WO2005/052314 the contents of which are incorporated herein by reference.

As with the swivel joint of WO2005/052314, the swivel joint of the present invention enables torque to be transmitted through the swivel joint until the lower part of the swivel joint is restrained from further downward movement and sufficient weight is then put on the upper part of the swivel joint. When sufficient weight is applied the swivel joint will be activated to a second configuration in which the weight applied to the upper part of the swivel joint is supported on a robust rolling element bearing pack and the torque transmitting structure provided between the swivel joint parts is disengaged so that the upper part of the swivel joint is able to be rotated freely relative to the lower part.

Accordingly to a first aspect of the present invention there is provided a downhole swivel joint comprising: a mandrel which forms the upper part of the swivel joint, said mandrel having a longitudinal through passage; a housing which forms the lower part of the swivel joint, a releasable retaining device for maintaining the mandrel and the housing in a first relative axial position until a pre-determined axial load is applied between the mandrel and the housing; the releasable retaining device being releasable upon imposition of said pre-determined axial load to allow the mandrel to move into a second axial position relative to the housing; means preventing rotation of the mandrel relative to the housing when the housing and the mandrel are in the said first relative axial position and permitting rotation of the mandrel relative to the housing when the mandrel and the housing are in the said second relative axial position, characterised in that respective apertures are provided in the wall of the mandrel and in the wall of the housing, the apertures being isolated from each other when the mandrel and the housing are in one of said relative axial positions and being in communication with each other to permit the flow of fluid from the interior of the mandrel to the exterior of the housing when the mandrel and the housing are in the other of the said relative axial positions.

The preferred embodiment to the present invention provides a downhole swivel joint assembly which is also able to function as a circulating valve. In the preferred embodiment of the present invention, when the mandrel and the housing are in their first relative axial position so that torque can be transmitted from the mandrel to the housing, the respective apertures are out of communication with each other so that fluid is unable to flow from the interior of the mandrel to the exterior of the housing via the apertures. When the tool is actuated, for example by landing the housing against a shoulder in a borehole and applying weight to the mandrel, the mandrel moves to the second axial position relative to the housing thereby simultaneously disengaging the torque transmitting means and placing the respective apertures in communication with each other to permit fluid flow. In this configuration the mandrel and all components of the work sting located there above can rotate freely relative to the housing, and fluid pumped into the mandrel through passage from above is able to flow via the apertures into the annulus surrounding the body.

In the preferred embodiment of the present invention a bearing structure is provided in the housing, the bearing structure being operative to transmit to the housing axial load imposed on the mandrel whilst permitting relative rotation between the mandrel and the housing. The bearing structure is preferably in the form of a bearing pack formed by multiple rolling element bearings. The rolling element bearings may be roller bearings but are preferably ball bearings. Such an arrangement is able to support a substantial axial load at both high and low rotational speeds. Ball bearings are preferred because they are better able to cope with debris with which they may be contaminated as a result of their operating environment than are roller bearings.

In the preferred embodiment to the present invention the bearing pack comprises a bearing shaft which is coaxial with the mandrel and, when the mandrel and the housing are in the first relative axial position, is axially spaced from the mandrel. A chamber is defined by the interior of the housing between the lower end of the mandrel and the upper end of the bearing shaft. A clearance space is provided around the upper end of the bearing shaft and passages are provided which extend through the bearing shaft to permit fluid from the chamber, around the edge of the upper end of the bearing shaft, through the passages and into the interior of the bearing shaft. Preferably, the bearing shaft at the lower end thereof is open and communicates with the exterior of the housing. Preferably, the upper end of the bearing shaft is provided with a nozzle and means are provided for forming a substantially fluid tight connection between the lower end of the mandrel and the upper end of the bearing shaft when the mandrel is in the second axial position relative to the housing. With such an arrangement, by appropriately selecting the size of the nozzle, the nozzle may be used to restrict fluid flow from the mandrel to the bearing shaft when the mandrel is in the second axial position relative to the housing. Such an arrangement may be used to increase the circulation of fluid through the apertures in the mandrel and housing. A blank (solid) nozzle may be fitted so that the flow into the interior of the bearing shaft is substantially prevented when the mandrel is in the second relative axial position. Such an arrangement will result in diversion of all fluid entering the other end of the mandrel outwardly through the apertures in the mandrel and the housing to the annulus.

The invention will be better understood from the following description of a preferred embodiment thereof given by way of example only, reference being had to the accompanying drawings wherein.

Figure 4:
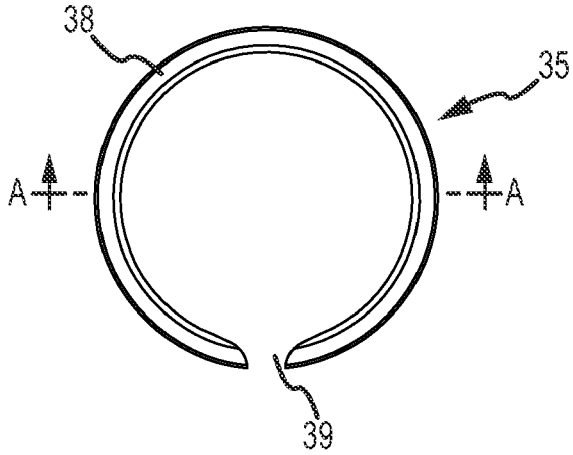
FIG. 4 is a top plan view of a retaining member used in the embodiments of FIGS. 1 and 2.
Figure 5:
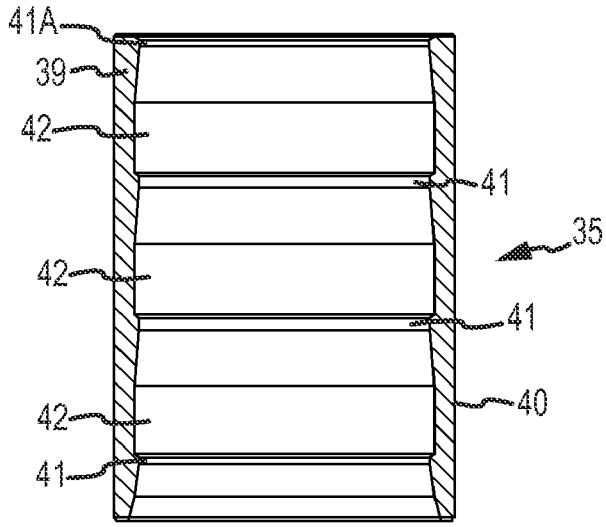
FIG. 5 is a section on the line AA of FIG. 4.
Figure 6:
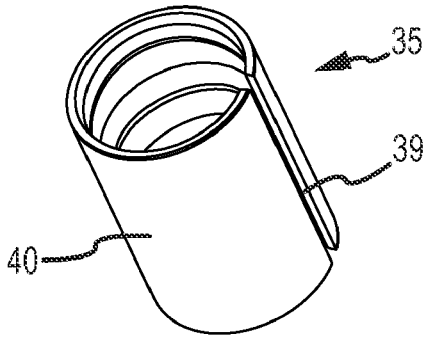

and FIG. 6 is a perspective view of the retaining member of FIGS. 4 and 5.

Referring now to the drawings, the illustrated swivel joint assembly I comprises a mandrel 2 and a plurality of components which are interconnected by appropriate screw threads to form a housing 3. The mandrel 2 extends from a threaded connector 4 located at the upper end thereof downwardly to a wave drive 5 at the lower end thereof. The housing extends from the upper end 6 thereof downwardly to a threaded pin connection 7 at the bottom thereof Within certain limits the mandrel 2 is telescopically moveable relative to the housing 3. In the condition in which the tool is deployed the components will be in the relative position shown in FIG. 1. This relative position is referred to throughout this description of the preferred embodiment as "the first relative axial position". In this position the weight of the housing 3 and any tools or piping located there below is supported on the mandrel by virtue of a shoulder 8A formed on a split journal bearing 9. The split journal bearing 9 is secured axially within the housing 3 by a threaded sleeve 9A and circlip 9B and is held against rotation relative to the housing 3 by screws 10. The shoulder 8A engages a corresponding shoulder 8B on the mandrel to transfer the axial loading of the housing 3 and any components connected to it to the mandrel 2. Additionally, with the components in the first relative axial position splines 1 on the mandrel engage corresponding splines 12 secured to the body in order to transmit torque applied to the mandrel to the body.

As illustrated, the mandrel is hollow and has a longitudinal passage 13 which extends throughout its entire length. Apertures 14 extend through the wall of the mandrel to provide fluid communication between the interior of the mandrel and the exterior surface thereof. Likewise, apertures 15 extends through the wall of the housing 3 to provide communication between the interior and the exterior thereof. The apertures 15 are preferably furnished with nozzles 15A to control the effective cross-sectional area of the apertures 15. With the mandrel and the housing in the first relative axial position illustrated in FIG. 1 the apertures 14 are out of register with the apertures 15 and fluid communication between the respective apertures is prevented by a seal assembly 16A. A further seal assembly 16B is located between the mandrel 2 and the housing 3 below the apertures 15 and a third seal assembly 16C is located between the mandrel 2 and the housing 3 above the apertures 14. All three seal assemblies 16A, 16B and 16C are dual directional seals.

A bearing assembly 17 is located within the housing 3 adjacent the lower end thereof The bearing assembly comprises a bearing shaft 18 and a plurality of ball bearings 19 stacked one atop another. The outer races of the ball bearings 19 are trapped between shoulders 20A and 20B provided by the housing 3 by spacers 21A and 21B. The inner races of the bearings 19 are trapped between a shoulder 22A provided on the bearing shaft 18 and a shoulder 22B provided on a shaft coupling 23 by spacers 24A and 24B. The arrangement is such that the bearing shaft 18 and shaft coupling 23 can rotate freely within the housing 3 whilst at the same time transmitting substantial axial thrust loading from the bearing shaft 18 to the housing 3, The bearing shaft 18 includes a central passage 25 which extends from end to end thereof, A nozzle 26 which is mounted in the shaft coupling 23 provides communication between the passage 25 and a chamber 27 located above the bearing assembly. The upper end of the shaft coupling 23 is provided with a wave profile 28 adapted to cooperate with the wave profile provided on the wave drive 5 of the mandrel 2.

A plurality of apertures 29 extends through the wall of the bearing shaft 18 to provide communication between the passage 25 and an annular chamber 30 defined between the bearing shaft 18 and the spacer 24B. A plurality of apertures 31 provide the spacer of 24B connect the annular chamber 30 to an annular chamber 32 defined between the spacer 24B and the spacer 21B. An annular passage 33 connects the chamber 32 to the chamber 27.

Figure 1A:
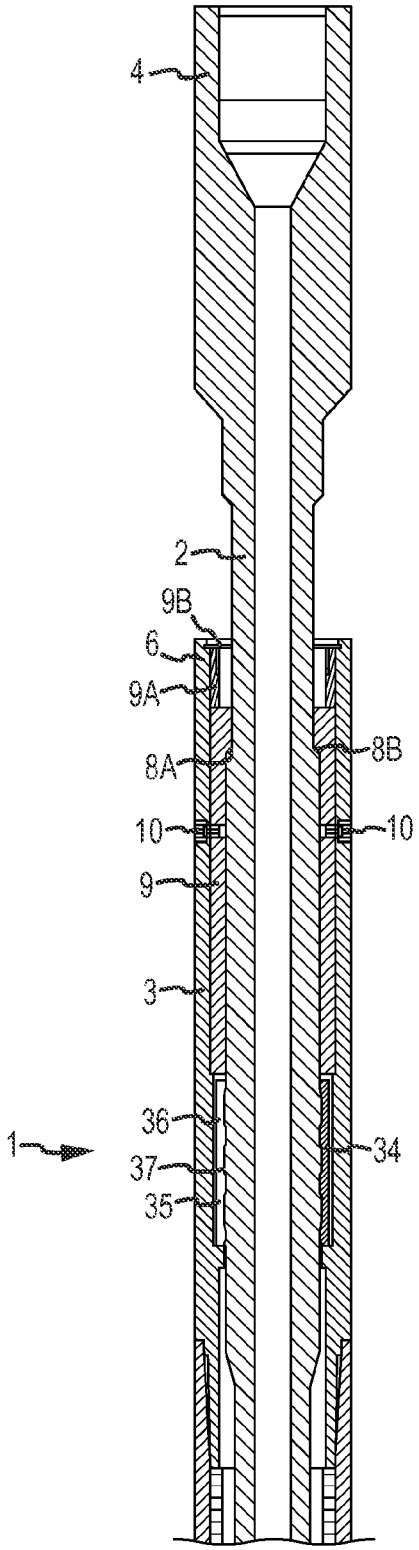
FIGS. 1A, 1B and 1C show respectively the upper part, the central part, and lower part of a swivel joint assembly in accordance with the preferred embodiment to the present invention, the components being arranged with the mandrel in a first axial position relative to the housing.
Figure 1B:
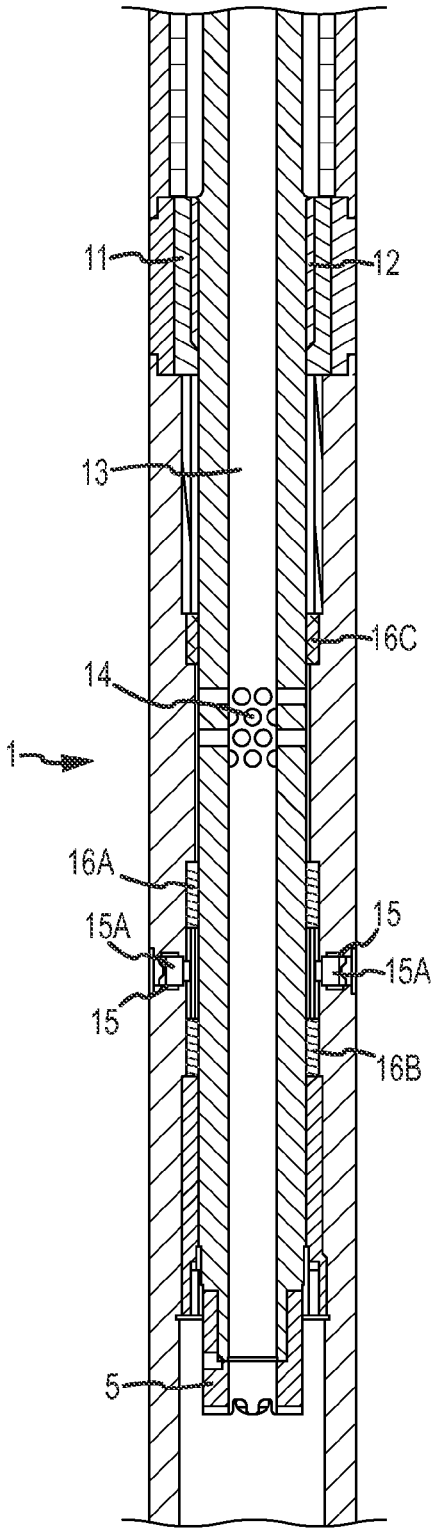
Figure 1C:
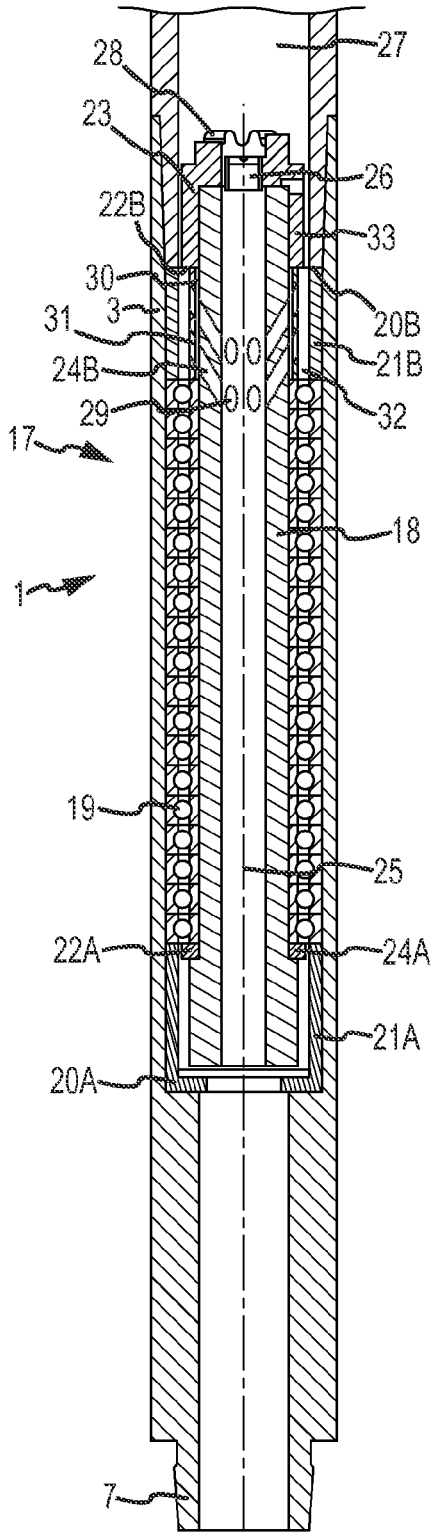

When the tool is assembled the various components are in the configuration illustrated in FIG. 1. The components are releasably maintained in this configuration by a retaining device 34 which comprise a retaining member 35 which is trapped within a pocket 36 formed in the housing 3, and a retaining profile 37 formed on the mandrel 2. The retaining member 35 is shown in greater detail in FIGS. 4-6 and is in the form of a sleeve 38 having a gap 39 extending the length thereof. The exterior 40 of the sleeve is a loose fit within the pocket 36 so that the retaining member may be radially expanded as described in more detail below. The interior of the retaining member is formed with a plurality of radially inwardly extending lands 41 separated by grooves 42. The surfaces which connect the lands to the grooves are in the form of sloping shoulders with the shoulder at the top of each land making an angle of for example 55° to the longitudinal axis of the retaining member and the shoulder at the bottom of each land making an angle of for example 5° to the longitudinal axis of the retaining member. An additional land 41A is provided at the upper end of the retaining member. This land has an upper shoulder which extends at 45° to the longitudinal axis of the retaining member and a lower shoulder which extends at 5° to the longitudinal axis of the retaining member. At the bottom end of the retaining member a lead-in taper of 15° is provided below the 5° taper of the bottom land.

The profile 37 provided on the mandrel is generally complementary to the profile provided on the interior of the retaining member 35 and comprises a plurality of lands separated by a plurality of grooves, each land being connected to the adjacent grooves by shoulders, each upper shoulder extending at an angle of for example 5° to the longitudinal axis of the mandrel and each lower shoulder extending at an angle of for example 55° to the longitudinal axis of the mandrel. The angles of the respective shoulders is selective in light of other characteristics of the retaining device to set the required activation and reset forces for the tool.

The retaining member 35 is sized to lightly resiliently grip the mandrel both when the retaining member 35 is in engagement with the mandrel profile 37 and after actuation of the tool when the retaining member 35 grips a plain portion of the mandrel surface. Typically, the components are designed to have an interference fit of a few thousandth of an inch. The effect of this arrangement is that the retaining member will rotate with the mandrel when the mandrel is rotated after activation of the tool.

The effect of the profiles provided on the two components making up the retaining device is that in response to an axial load applied tending to telescope the mandrel 2 into the housing 3 the profile on the mandrel is able to cam open the retaining member to enable the mandrel lands to snap over the retaining member 35 lands until the mandrel retaining profile is clear of the retaining member. Thereafter, application of axial loading between the mandrel 2 and the housing 3 tending to withdraw the mandrel from the housing will result in the caming open of the retaining member to allow the components to re-establish the position illustrated in FIG. 1. It will be noted, however, that because of the asymmetric nature of the shoulders which connect the respective lands to the adjacent grooves the force necessary to telescope the mandrel into the housing is substantially greater than the force necessary subsequently to telescope the mandrel in the direction out of the housing. The forces required clan be adjusted by selection of the respective angles of the shoulders at the upper and lower ends of the lands and/or by appropriate selection of the material and material thickness of the retaining member.

In use, the various components are made up into the configuration illustrated in FIG. 1 and a tool is connected in a string and lowered into a wellbore. As noted above, in the configuration illustrated in FIG. 1 torque applied to the mandrel will be transmitted via the splines 11, 12 to the housing and accordingly to any components located below the swivel joint. Also, well fluid pumped down the passage 13 will flow out of the bottom of the mandrel into the chamber 27 and then via the central passage of the nozzle 26 and by the passage 33, chamber 32, apertures 31, chamber 30 and apertures 29 to the passage 25 of the bearing shaft 18. The passage 18 is open at the bottom end thereof to allow fluid to flow out of the bottom of the swivel joint assembly. If desired, the nozzle 26 may be blank—that is closed so that no fluid can flow through it. Under these circumstances, fluid is still able to flow from the chamber 27 to the passage 25 of the bearing shaft via the secondary route formed by the passage 33, chamber 32, apertures 31, chamber 30 and apertures 29.

When it is required to disconnect the splines 11, 12 downward passage of the housing 3 is arrested by suitable means, for example by landing on a shoulder provided within the wellbore such as the top of a liner casing. A landing sub will normally be attached to the lower end of the tool to provide an external shoulder on the workstring.

Once downward movement of the housing 3 has been arrested weight is applied to the mandrel 2 until the retaining device 34 is overcome whereupon the mandrel 2 will move downwardly within the housing 3 until the wave profile of the wave drive 5 engages the wave profile of the shaft coupling 23. At this point further downward movement of the mandrel 2 relative to the housing will be prevented and axial thrust applied in the downward direction to the mandrel 2 will be reacted via the bearing assembly 17, onto the housing. At this point, the various components will have assumed the configuration illustrated in FIG. 2.

Figure 2:
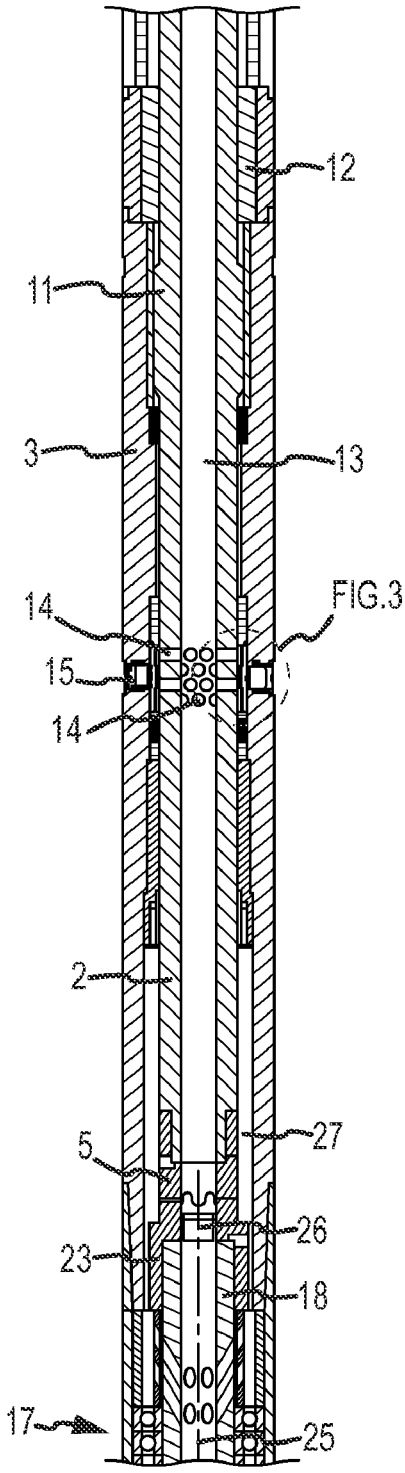
FIG. 2 illustrates a central region of the swivel joint assembly shown in FIG. 1 after axial load has been applied to the mandrel to place the mandrel and the housing in the second relative axial position.
Figure 3:
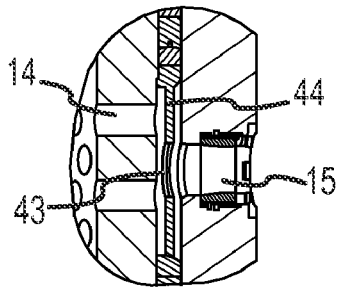
FIG. 3 is an enlarged view of the area circled by a dotted line in FIG. 2.

It will be noted from FIG. 2 that in the configuration illustrated the splines 11 of the mandrel are disengaged from the splines 12 of the housing with the result that the mandrel 2, supported on the bearing assembly 17, is able to rotate freely within the housing. The mutually inter-engaging wave profiles of the wave drive 5 and the shaft coupling 23 transmit sufficient torque from the mandrel 2 to the bearing shaft 18 to ensure that rotation is accommodated by the bearing assembly 17.

In the configuration illustrated in FIG. 2 the apertures 14 provided in the mandrel have moved to an axial position corresponding to the apertures IS provided in the housing, with the result that fluid from the central passage 13 of the mandrel is able to flow to the annulus via the apertures 14, apertures 43 provided in a seal spacer of 44, and the nozzles 15A of the housing 3. Also, the engagement of the wave drive 5 and the shaft coupling 23 is substantially fluid tight with the result that the chamber 27 is now isolated from the central passage 13 of the mandrel 2. As a result, the only route available for fluid to flow from the passage 13 of the mandrel 2 into the passage 25 of the bearing shaft is via a central passage of the nozzle 26. By appropriate choice of the size of the nozzle 26 and the nozzles 15A the flow entering the mandrel passage 13 may be split with part of the flow continuing through the nozzle 26 and part of the flow diverted through nozzles 15A. If desired, the nozzle 26 may be a blank nozzle—i.e. without a through passage with the result that the entire flow from the passage 13 will exit to the annulus via the nozzles 15A. After actuation, the string above the tool will normally be rotated while the string below the tool is stationary and fluid is diverted outwardly through the nozzles 15. The seals 16 each comprise a dual directional seal pair. It will be noted that the seals 16A, 16B and 16C are rotational seals which accommodate the rotation of the mandrel relative to the housing which occurs after actuation of the tool. In each case, the seals remain stationary in the housing whilst the mandrel rotates on the inner lips of the seals. If reverse circulation is applied before the tool is actuated flow will not enter the interior of the tool directly from the annulus.

When the required circulation operation has been completed the downward thrust on the mandrel 2 is relieved and load is picked up on the mandrel to lift the mandrel and the components of the string assembly below it. If the weight of the components below the mandrel is sufficient, picking up on the mandrel automatically applies sufficient force tending to telescope the mandrel out of the housing to reset the retaining device to the configuration shown in FIG. 1. The reset force required can be minimised by reducing the angle of the reset shoulders on the retaining member and mandrel. If very few components are located below the housing 3 the tool can be reset either by increasing the axial force on the mandrel downhole for example by increasing the speed of upward movement of the tool to increase drag forces on the housing 3 and the components located there below. In general, it is expected that there will be sufficient weight below the tool to reset it as it is pulled off the landing shoulder. However, if in particular circumstances there is insufficient weight to reset the tool, the tool can be reset on the surface by suitable means applying an axial force between the mandrel and the housing intended to telescope the mandrel out of the housing. Once the tool has been reset to the configuration illustrated in FIG. 1 it may be re-used. It will be noted, in particular, that the full sequence of operation does not involve use of any shear elements and the tool after re-setting may be immediately re-used without any stripping down or replacement of parts.

The invention claimed is:

1. A downhole swivel joint comprising: a mandrel which forms the upper part of the swivel joint, said mandrel having a longitudinal through passage; a housing which forms the lower part of the swivel joint, a releasable retaining device for maintaining the mandrel and the housing in a first relative axial position until a pre-determined axial load is applied between the mandrel and the housing; the releasable retaining device being releasable upon imposition of said pre-determined axial load to allow the mandrel to move into a second axial position relative to the housing; and means preventing rotation of the mandrel relative to the housing when the housing and the mandrel are in the said first relative axial position and permitting rotation of the mandrel relative to the housing when the mandrel and the housing are in the said second relative axial position, characterised in that respective apertures are provided in the wall of the mandrel and in the wall of the housing, the apertures being isolated from each other when the mandrel and the housing are in one of said relative axial positions and being in communication with each other to permit the flow of fluid from the interior of the mandrel to the exterior of the housing when the mandrel and the housing are in the other of the said relative axial positions, wherein the releasable retaining device comprises a radially resiliently deformable member arranged so as to be resiliently deformed when said components are moved from the first relative axial position to the second relative axial position and the mandrel and the housing are in their first relative axial position so that torque can be transmitted from the mandrel to the housing, the respective apertures are out of communication with each other.

2. A downhole swivel joint according to claim 1 wherein a bearing structure is provided in the housing, the bearing structure being operative when the mandrel and the housing are in the second relative axial position to transmit to the housing axial loads imposed on the mandrel whilst permitting relative rotation between the mandrel and the housing.

3. A downhole swivel joint comprising: a mandrel which forms the upper part of the swivel joint, said mandrel having a longitudinal through passage; a housing which forms the lower part of the swivel joint, a releasable retaining device for maintaining the mandrel and the housing in a first relative axial position until a pre-determined axial load is applied between the mandrel and the housing; the releasable retaining device being releasable upon imposition of said pre-determined axial load to allow the mandrel to move into a second axial position relative to the housing; and means preventing rotation of the mandrel relative to the housing when the housing and the mandrel are in the said first relative axial position and permitting rotation of the mandrel relative to the housing when the mandrel and the housing are in the said second relative axial position, characterized in that respective apertures are provided in the wall of the mandrel and in the wall of the housing, the apertures being isolated from each other when the mandrel and the housing are in one of said relative axial positions and being in communication with each other to permit the flow of fluid from the interior of the mandrel to the exterior of the housing when the mandrel and the housing are in the other of the said relative axial positions, wherein the releasable retaining device comprises a radially resiliently deformable member arranged so as to be resiliently deformed when said components are moved from the first relative axial position to the second relative axial position and the mandrel and the housing are in their first relative axial position so that torque can be transmitted from the mandrel to the housing, the respective apertures are out of communication with each other a bearing structure is provided in the housing, the bearing structure being operative when the mandrel and the housing are in the second relative axial position to transmit to the housing axial loads imposed on the mandrel whilst permitting relative rotation between the mandrel and the housing, and wherein the bearing structure is in the form of a bearing pack formed by multiple rolling element bearings.

4. A downhole swivel joint according to claim 3 wherein the bearing pack comprises a bearing shaft that is coaxial with the mandrel and, when the mandrel and the housing are in the first relative axial position, is axially spaced from the mandrel.

5. A downhole swivel joint according to claim 4 wherein: a chamber is defined by the interior of the housing between the lower end of the mandrel and the upper end of the bearing shaft, a clearance space is provided around the upper end of the bearing shaft; and passages are provided which extend through the bearing shaft to permit fluid from the chamber, through the clearance space, through the passages and into the interior of the bearing shaft.

6. A downhole swivel joint according to claim 5 wherein: the bearing shaft at the lower end thereof is open and communicates with the exterior of the housing; the upper end of the bearing shaft is provided with a nozzle; and means are provided for forming a substantially fluid tight connection between the lower end of the mandrel and the upper end of the bearing shaft when the mandrel is in the second axial position relative to the housing.

7. A downhole swivel joint according to claim 6 wherein the nozzle is a blank (solid) nozzle, so that flow into the interior of the bearing shaft is substantially prevented when the mandrel is in the second relative axial position.

8. A downhole swivel joint comprising: a mandrel which forms the upper part of the swivel joint, said mandrel having a longitudinal through passage; a housing which forms the lower part of the swivel joint, a releasable retaining device for maintaining the mandrel and the housing in a first relative axial position until a pre-determined axial load is applied between the mandrel and the housing; the releasable retaining device being releasable upon imposition of said pre-determined axial load to allow the mandrel to move into a second axial position relative to the housing; and means preventing rotation of the mandrel relative to the housing when the housing and the mandrel are in the said first relative axial position and permitting rotation of the mandrel relative to the housing when the mandrel and the housing are in the said second relative axial position, characterized in that respective apertures are provided in the wall of the mandrel and in the wall of the housing, the apertures being isolated from each other when the mandrel and the housing are in one of said relative axial positions and being in communication with each other to permit the flow of fluid from the interior of the mandrel to the exterior of the housing when the mandrel and the housing are in the other of the said relative axial positions, the releasable retaining device comprising a radially resiliently deformable member arranged so as to be resiliently deformed when said components are moved from the first relative axial position to the second relative axial position, the resiliently deformable member resiliently resists movement of the mandrel from the second relative axial position to the first relative axial position, the force needed to move the mandrel from the first relative axial position to the second relative axial position being greater than the force necessary to move the mandrel from the second relative axial position to the first relative axial position wherein said resiliently deformable member is retained in a fixed axial position relative to one of said mandrel and said housing and comprises a first cam surface, the other of said mandrel and said housing being provided with a second cam surface for co-operating with the first cam surface to radially cam said resiliently deformable member into a resiliently deformed configuration as the mandrel moves from the first relative axial position to the second relative axial position.

9. A downhole swivel joint according to claim 8 wherein said resiliently deformable member comprises a third cam surface, said other one of said mandrel and said housing being provided with a fourth cam surface for co-operating with the third cam surface and radially camming said resiliently deformable member into a resiliently deformed configuration as the mandrel moves from the second relative axial position to the first relative axial position.

10. A downhole swivel joint according to 9 wherein said resiliently deformable member comprises a cylindrical wall having a slot extending through the fill thickness of the wall and along the full length of the cylindrical wall.

11. A downhole swivel joint according to claim 8 wherein the first relative axial position and the second relative axial position are both mechanically stable configurations.

* * * * *